US006984114B2

(12) United States Patent
Zili et al.

(10) Patent No.: US 6,984,114 B2
(45) Date of Patent: Jan. 10, 2006

(54) TWO-STEP SELF-MODULATING SCROLL COMPRESSOR

(75) Inventors: Sun Zili, Arkadelphia, AR (US); Oo Chong Yeow, Hot Springs, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/919,822

(22) Filed: Aug. 17, 2004

(65) Prior Publication Data

US 2005/0042125 A1 Feb. 24, 2005

Related U.S. Application Data

(63) Continuation of application No. 10/607,282, filed on Jun. 26, 2003.

(51) Int. Cl.
*F04B 49/00* (2006.01)

(52) U.S. Cl. ..... 417/310; 418/55.1; 418/24; 417/308

(58) Field of Classification Search ..... 418/55.1, 418/270, 40, 41, 24–27; 417/308, 310
See application file for complete search history.

(56) References Cited

U.S. PATENT DOCUMENTS

| | | | | | |
|---|---|---|---|---|---|
| 4,669,962 | A | * | 6/1987 | Mizuno et al. | 418/55.5 |
| 4,904,164 | A | * | 2/1990 | Mabe et al. | 417/310 |
| 5,236,316 | A | * | 8/1993 | Iio | 417/310 |
| 5,356,271 | A | * | 10/1994 | Miura et al. | 417/310 |
| 5,993,171 | A | * | 11/1999 | Higashiyama | 417/310 |
| 6,551,069 | B2 | * | 4/2003 | Narney et al. | 417/310 |

FOREIGN PATENT DOCUMENTS

| | | | | |
|---|---|---|---|---|
| JP | 63212789 | A | | 9/1988 |
| JP | 63212789 | A | * | 9/1988 |
| JP | 01106990 | A | | 4/1989 |
| JP | 01106990 | A | * | 4/1989 |
| JP | 04287888 | A | | 10/1992 |
| JP | 04287888 | A | * | 10/1992 |

* cited by examiner

*Primary Examiner*—Theresa Trieu
(74) *Attorney, Agent, or Firm*—Carlson, Gaskey & Olds

(57) ABSTRACT

A self-modulating scroll compressor includes a pair of valves. A first valve moves to a low capacity position when the pressure differential is below a predetermined amount. A second valve moves to a low capacity position when the suction pressure is above a predetermined amount. Low capacity operation will only occur when both valves are open. The present invention thus provides a scroll compressor design with the ability to self-modulate and control the conditions under which low capacity operation occurs based upon two criteria.

10 Claims, 2 Drawing Sheets

VALVE STATUS @ ZONE (1)

VALVE STATUS @ ZONE (2)

VALVE STATUS @ ZONE (3)

VALVE STATUS @ ZONE (4)

TWO-STEP SELF-MODULATING SCROLL COMPRESSOR

This is a continuation of application Ser. No. 10/607,282, file Jun. 26, 2003.

BACKGROUND OF THE INVENTION

This invention relates to a scroll compressor which self-modulates between high and low capacity based upon two distinct criteria.

Scroll compressors are becoming widely utilized in refrigerant compression applications. In a scroll compressor, a first scroll member has a base and a generally spiral wrap extending from the base. A second scroll member is held in a non-orbiting fashion relative to the first scroll member and has a wrap that interfits with a wrap from the first scroll member. The first scroll member is driven to orbit relative to the second, and the interfitting wraps define compression chambers for compressing an entrapped refrigerant.

It is a goal in modern compressor design to be able to provide at least two capacity levels. In some instances, such as when the cooling load on a refrigerant cycle is not particularly high, a lower capacity may be desirable. Less energy is used to compress a lesser amount of refrigerant in low capacity operations. Thus, various modulation schemes have been developed in the prior art.

In one modulation scheme, the compressor moves to low capacity operation when the pressure differential is low. The pressure differential is the delta (difference) of the discharge pressure to the suction pressure. When this quantity is low, there is some indication that lower capacity operation may be in order.

This prior art compressor performs adequately to provide low capacity operation when the compressor is utilized in an air conditioning cycle. However, it is also desirable to use such compressors as part of a heat pump system. In a compressor that is utilized for both air conditioning and heat pump operation, there are times when a relatively low pressure differential is not indicative of a need for low capacity. In particular, if the suction pressure is also low, the compressor may be operating in heat pump mode, and high capacity operation would still be desirable. The prior art will still provide low capacity operation under those circumstances.

SUMMARY OF THE INVENTION

In a disclosed embodiment of this invention, two distinct criteria are considered by the self-modulating capacity control. A first valve is operative to move between an open and closed position based upon the suction pressure. If the suction pressure is low, then the valve is maintained in the closed position, and high capacity operation occurs. A second valve is maintained in a closed position when the pressure differential is high. As long as either of these two conditions (low suction pressure or high pressure differential) are maintained, then high capacity operation occurs. However, if neither condition occurs, then both valves move to the open position and the compressor self-modulates to low capacity operation.

These and other features of the present invention can be best understood from the following specification and drawings, the following of which is a brief description.

DETAILED DESCRIPTION OF THE PREFERRED EMBODIMENT

Figure 1:
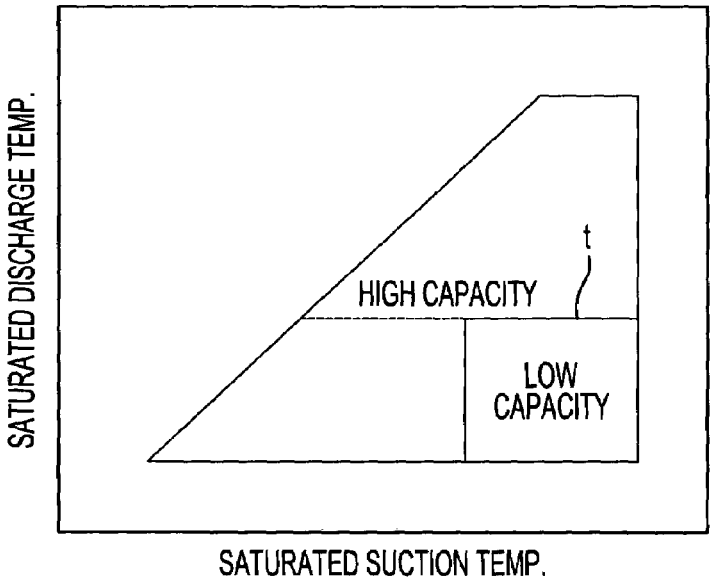
FIG. 1 shows a capacity envelope.

FIG. 1 shows a desired capacity envelope for a scroll compressor which could be utilized in both heat pump and air conditioning applications. As mentioned previously, the prior art does not have the low capacity condition confined only to the right side of the overall envelope. Instead, the top line t of the low capacity envelope, extended to the left as shown in dotted line with the prior art compressor. As mentioned above, the area to the left of the low capacity envelope shown in FIG. 1 would desirably be maintained at high capacity operation at least during heat pump operation.

Figure 2:
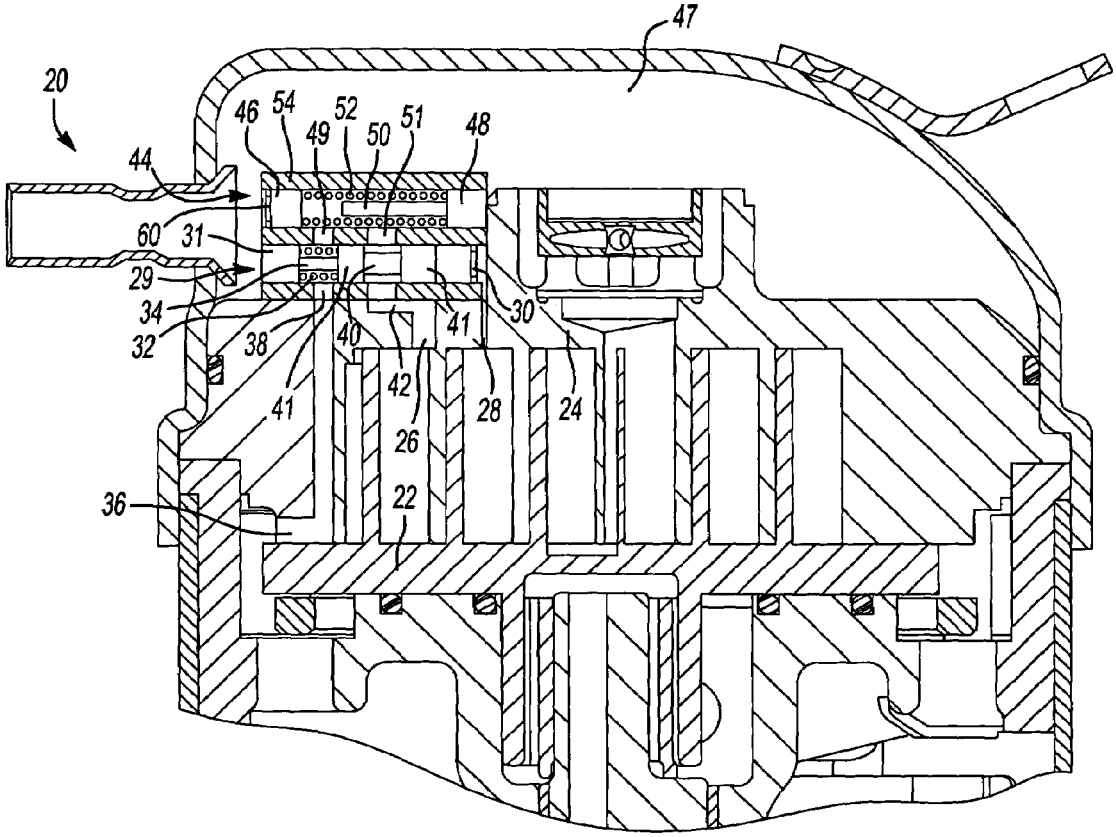
FIG. 2 is a cross-sectional view through a scroll compressor embodying the present invention.

The compressor shown in FIG. 2 achieves the envelope shown in FIG. 1. The compressor 20 incorporates an orbiting scroll 22 orbiting relative to a non-orbiting scroll 24. An intermediate pressure dump 26 and a intermediate pressure tap 28 deliver refrigerant into a valve chamber associated with a valve 29. Valve 29 is responsive to overall suction pressure. Suction pressure, as is known, is related by a multiplier to the intermediate pressure. A spring 32 drives the valve body 40 away from a valve stop 31 having a pin 34. As shown in FIG. 2, suction pressure 36 leads to a tap 38 on a side of the valve body 40 that also includes the spring 32. Thus, suction pressure and the spring force drives the valve 40 to the right against the intermediate pressure force. As can be seen in FIG. 2, the intermediate pressure passing through dump 26 moves into a passage 42. Thus, this intermediate pressure is delivered intermediate to enlarged portions 41 of the valve body 40. Since this intermediate pressure "sees" both portions 41, it does not effect the position of the valve body 40. However, as is also clear, the intermediate pressure through tap 28 passes into a chamber on the right side of the valve body 40, and its rightmost enlarged portion 41, and drives the valve body 40 to the left. As the suction pressure increases, the difference between the intermediate pressure and the suction pressure also increases, and eventually the position of the valve body 40 moves to that shown in FIG. 2. As shown, the valve 40 includes a necked-down intermediate portion between the two enlarged portions 41.

A valve stop is identified by element 30, which stops the valve body 40 as it is driven to the right. As a worker of ordinary skill in the art would appreciate, the valve stop 30 is configured such that fluid can pass from the tap 28 into the chamber to the left of the valve stop 30, and against the rightmost of the enlarged portions 41.

Figure 3A:
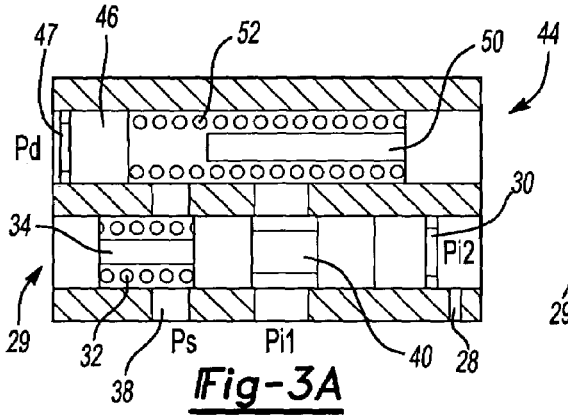
FIG. 3A shows a compressor control under conditions resulting in low capacity.

A second valve 44 includes a piston 46 in a housing 54 that sees discharge pressure on the left hand side from a discharge pressure chamber 47. A suction pressure tap 49 and an intermediate pressure tap 51 deliver refrigerant pressure into a chamber to the right hand side of the piston 46. A stop 50 and 48 will stop piston 46 when it is driven to the right from the illustrated position. This pressure fluid along with the spring force 52 tends to hold the piston 46 at the illustrated position against a piston stop 60. In FIG. 2, both the valves 29 and 44 are shown in the open position such that refrigerant can flow from the dump 26, into lines 42, 51, 49 and 38 back to suction 36. Thus, with the valves 29 and 44 in the position illustrated in FIG. 2, low capacity operation is achieved. As can be appreciated from FIG. 2, the refrigerant tap through line 42 is simply the refrigerant to be dumped under low capacity operation. FIG. 3A shows this same low capacity operation. This is a condition wherein the suction pressure is above a particular amount and the pressure differential is below a particular amount. This is zone 1 of FIG. 4. Under these conditions, low capacity operation is desirable.

Figure 3B:
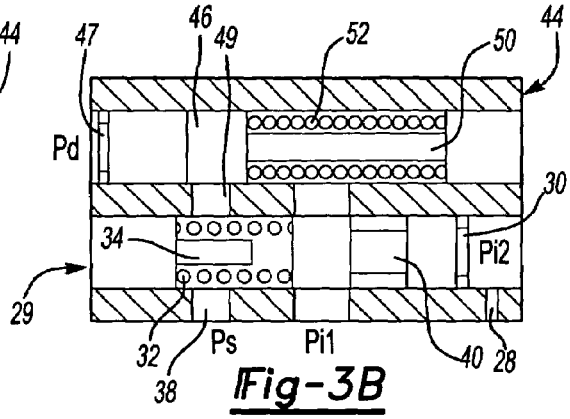
FIG. 3B shows one condition wherein high capacity would still be maintained.
Figure 4:
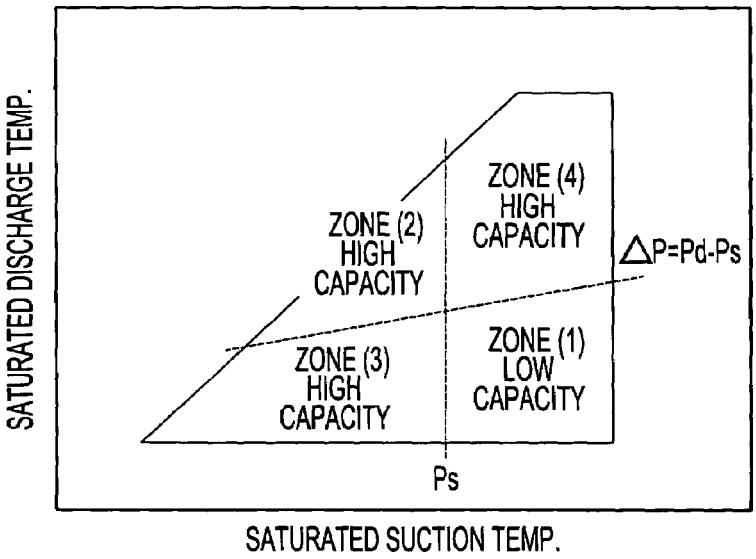
FIG. 4 is a graph showing the conditions that will result in the four valve positions of FIGS. 3A–3D.

As shown in FIG. 3A, the pressure differential is now increased such that the discharge pressure to the left side of the piston 46 has overcome the force on the right side of the piston 46. Under these conditions, the piston 46 blocks the tap 49 and refrigerant is no longer bypassed. Thus, high capacity operation occurs. As shown in FIG. 3B, the suction pressure is also low such that the valve body 40 has moved to the right blocking line 42. For this separate reason, high capacity operation will occur. As shown in FIG. 4, this would be zone 2.

Figure 3C:
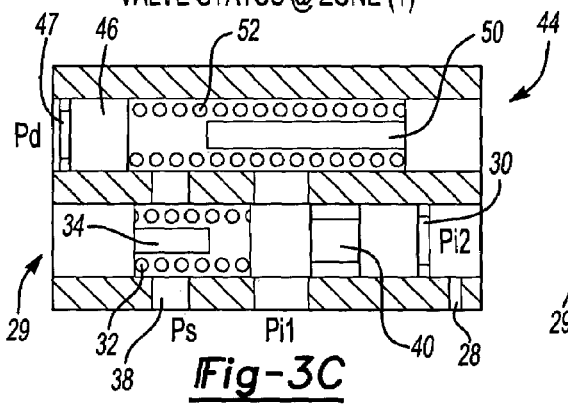
FIG. 3C shows another high capacity condition.

As shown in FIG. 3C, the pressure differential is lower. However, the suction pressure is still sufficiently low that the valve 40 remains in a position blocking line 42. High capacity operation will still occur. This is zone 3 from FIG. 4.

Figure 3D:
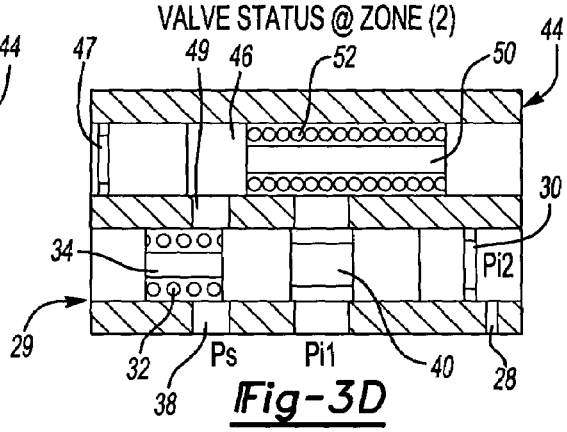
FIG. 3D shows yet another high capacity condition.

FIG. 3D shows the condition wherein the pressure differential is sufficiently high to drive the piston 46 to the right, while the suction pressure is also sufficiently high such that the valve body 40 moves to the open position. Even so, since the piston 46 blocks flow through the line 49, high capacity operation still occurs. This is zone 4 from FIG. 4.

In sum, the present invention discloses a simple system which requires two distinct conditions to occur before the compressor self-modulates to low capacity operation. Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A sealed compressor comprising:

a compressor pump unit for compressing a refrigerant in at least one compression chamber; and a capacity control which is self-modulating based upon refrigerant conditions, said capacity control including two distinct valves with a first valve and a second valve, said second valve moving to a low capacity condition when a pressure differential between a more compressed refrigerant and a less compressed refrigerant is below a first predetermined amount, and said first valve moving to a low capacity condition when a suction pressure is above a second predetermined amount such that low capacity operation only occurs when said pressure differential is below said first predetermined amount and said suction pressure is above said second predetermined amount, and said capacity control only moving said compressor pump unit to a low capacity operation when both said first and second valves are in said low capacity condition.

2. The sealed compressor as recited in claim 1, wherein said second valve includes a piston which sees a discharge pressure on one face, and a lower pressure along with a spring force on a second face, such that said piston moves to a position blocking flow of refrigerant from the compression chamber to the suction chamber if said pressure differential is above said first predetermined amount.

3. The sealed compressor as recited in claim 1, wherein said sealed compressor is utilized in both a heat pump mode and an air conditioning mode.

4. The sealed compressor as recited in claim 1, wherein said compressor pump unit is a scroll compressor unit.

5. A sealed compressor comprising:

a compressor pump unit for compressing a refrigerant in at least one compression chamber; and a capacity control which is self-modulating based upon refrigerant conditions, said capacity control including two distinct valves with a first valve and a second valve, said second valve moving to a low rapacity condition when a pressure differential between a more compressed refrigerant and a less compressed refrigerant is below a first predetermined amount, and said first valve moving to a low capacity condition when a suction pressure is above a second predetermined amount such that low capacity operation only occurs when said pressure differential is below said first predetermined amount and said suction pressure is above said second predetermined amount;

said first valve having a first chamber for receiving the suction pressure refrigerant and a spring force, said first chamber biasing a piston towards a second chamber which receives an intermediate refrigerant from the compression chamber, said first valve moving to a position allowing flow of refrigerant from the compression chamber back to a suction chamber if said suction pressure is above said second predetermined amount.

6. The sealed compressor as recited in claim 5, wherein said second valve includes a piston which sees a discharge pressure on one face, and a lower pressure along with a spring force on a second face, such that said piston moves to a position blocking flow of refrigerant from the compression chamber to the suction chamber if said pressure differential is above said first predetermined amount.

7. The sealed compressor as recited in claim 5, wherein said first valve is movable in a valve chamber, and said first valve having two enlarged portions and an intermediate thinner portion, said intermediate thinner portion being aligned with an intermediate pressure dump for dumping refrigerant from an intermediate compression chamber back to a suction pressure chamber when said suction pressure is above said second predetermined amount.

8. A sealed compressor comprising:

a compressor pump unit for compressing a refrigerant in at least one compression chamber;

capacity control which is self-modulating based upon refrigerant conditions, said capacity control including two distinct valves with a second valve moving to a low capacity condition when a pressure differential between a more compressed refrigerant and a less compressed refrigerant is below a first predetermined amount, and a first valve moving to a low capacity condition when a suction pressure is above a second predetermined amount such that low capacity operation only occurs when said pressure differential is below said first predetermined amount and said suction pressure is above said second predetermined amount, said first valve has a first chamber for receiving the suction pressure refrigerant and a spring force, said first chamber biasing a piston towards a second chamber which receives an intermediate refrigerant from the compression chamber, said first valve moving to a position allowing flow of refrigerant from the compression chamber back to the suction chamber if said suction pressure is above said second predetermined amount, said second valve includes a piston which sees a discharge pressure on one face, and a lower pressure along with a spring force on a second face, such that said piston moves to a position blocking flow of refrigerant from a compression chamber to a suction chamber if said pressure differential is above said first predetermined amount; and said sealed compressor being utilized in a heat pump mode as well as an air conditioning mode.

9. The sealed compressor as recited in claim 8, wherein said first valve is movable in a valve chamber, and said first valve having two enlarged portions and an intermediate thinner portion, said intermediate thinner portion being aligned with an intermediate pressure dump for dumping refrigerant from an intermediate compression chamber back to a suction pressure chamber when said suction pressure is above said second predetermined amount.

10. A sealed compressor as recited in claim 8, wherein said compressor pump unit is a scroll compressor unit.

* * * * *

UNITED STATES PATENT AND TRADEMARK OFFICE

CERTIFICATE OF CORRECTION

PATENT NO. : 6,984,114 B2
APPLICATION NO. : 10/919822
DATED : January 10, 2006
INVENTOR(S) : Zili Sun and Chong Yeow Oo It is certified that error appears in the above-identified patent and that said Letters Patent is hereby corrected as shown below:

Title page, item (75) inventors names should be listed as --Zili Sun and Chong Yeow Oo--.

Signed and Sealed this

Tenth Day of April, 2007

JON W. DUDAS
*Director of the United States Patent and Trademark Office*